United States Patent [19]

Gregory

[11] 4,078,494

[45] Mar. 14, 1978

[54] FLEXIBLE LETTER PRESS PRINTING PLATE

[75] Inventor: Howard W. Gregory, Baie d'Urfe, Canada

[73] Assignee: stanMont, Inc., Montreal, Canada

[21] Appl. No.: 655,226

[22] Filed: Feb. 4, 1976

[51] Int. Cl.[2] ..... B41N 1/00; B41N 3/00

[52] U.S. Cl. ..... 101/456; 96/35; 96/35.1; 96/36.3; 101/401.1; 101/401.2; 101/401.3; 101/457; 264/220; 264/226; 264/227

[58] Field of Search ..... 96/36.3, 38, 35, 35.1; 101/401.1, 401.3, 401.2, 454, 456, 457; 264/219, 220, 226, 227

[56] References Cited

U.S. PATENT DOCUMENTS

| | | | |
|---|---|---|---|
| 2,257,143 | 9/1941 | Wood | 96/36.3 |
| 2,374,910 | 5/1945 | Yanes | 101/401.2 |
| 2,454,729 | 11/1948 | Yanes | 101/401.2 |
| 2,978,324 | 4/1961 | Heussner | 96/38 |
| 3,364,090 | 1/1968 | Slipp | 264/220 |
| 3,408,437 | 10/1968 | Wheeler et al. | 264/226 |
| 3,806,575 | 4/1974 | Fishburn | 96/36.3 |
| 3,931,762 | 1/1976 | Fukushima et al. | 264/220 |

*Primary Examiner*—Edward C. Kimlin
*Attorney, Agent, or Firm*—Fetherstonhaugh & Company

[57] ABSTRACT

A letter press printing plate is disclosed for wrapping around a drum. The printing surface is formed with a light-sensitive material layer on a metal backing plate with two different levels, the high level representing areas of solid or dark tones of printing and the low level representing areas of light tones of printing. The printing plate overcomes the problem of even transfer of ink from the solid or dark tones of printing areas and the light tones of printing areas. A method of forming the letter press printing plate is also disclosed wherein a photo polymer layer on a backing plate is first exposed to a negative representing areas of solid or dark tones and light tones of printing. The photo polymer layer is then dissolved away to the backing plate in areas where no printing occurs and formed into a two-level printing surface with the areas of solid or dark tones being at a high level and the areas of light tones being at a low level.

4 Claims, 7 Drawing Figures

FLEXIBLE LETTER PRESS PRINTING PLATE

This invention relates to a graphic arts make-ready printing system and more particularly to a flexible letter press printing plate and a method of producing the printing plate.

Letter press printing in colour is carried out in three printing steps, one step for each of the three colours cyan, magenta and yellow. Each colour print is printed by three separate printing plates in each of the three colours. Each printing plate is prepared individually from a special photograph which is taken by a camera with special filters over the lens to blank out the other two colours. A negative is produced having a series of opaque areas where no printing is to occur, and transparent areas where printing is required. The transparent area is in the form of dots to represent tones or shades of colour. Large transparent dots, close together, represent dark tones, and small transparent dots, spaced apart, represent light tones. Thus the range of tones from light to heavy is represented by the arrangement of dots. Consequently, it is possible to acquire any desired colour tone on the final colour print by varying the arrangement of dots for each of the three colour printing steps.

The negative is used to produce a special printing plate. The printing plate has a flexible sheet metal backing plate with an even layer of a light-sensitive material such as a photo polymer coated on the top thereof to form the printing surface. The photo polymer material may be any one of several commercially available light-sensitive emulsions. The negative is aligned over the photo polymer layer of the printing plate and held securely to the plate by a vacuum whilst being exposed for a predetermined time to a high-intensity light. The light hardens and sets the photo polymer material. The plate is then washed and the photo polymer material under the opaque areas of the negative are washed away. Thus, the resulting plate has areas of hardened photo polymer material representing full printing, areas where no coating material exists representing no printing, and areas of light tone to dark tone which are produced as a series of dots of photo polymer material. The resulting printing plate thus has one printing surface which is at the same level across the plate.

In most letter press printing, the finished plate is wrapped around a drum with the printing surface on the outside. As the drum rotates, ink is rolled onto the printing surface which then presses onto paper passing beneath the drum, thus printing on the paper. The paper is passed beneath three drums with printing plates for the three colours of ink, and the end result is a colour print.

One problem that exists with this type of printing is that the large areas of solid printing or dark tone printing require more impression, or paper-to-plate pressure, than the light tones or small dot areas are able to accommodate; thus when the paper passes under the drum, the small dots which represent light tones of printing touch the paper and tend to penetrate the surface, which causes a poor transfer of ink from the printing surface to the paper. The large areas of solid printing generally have a good transfer of ink around their edges, but not in the centre. If the pressure is increased between the drum and the paper, then the small dots in the printing surface tend to penetrate too far into the paper and cause too much ink to transfer onto the paper. One of the reasons for this problem is that much of the letter press printing today takes place on newsprint which is a low quality paper with a fairly rough surface. To overcome this problem, strips of paper or other thickening material may be added directly underneath the backing plate in the areas of solid printing and dark tone printing. Thus, when the printing plate is attached to the drum these thickened areas apply a higher pressure between the printing surface and the paper which improves the solid printing and dark tone printing.

The make-ready system, as it is referred to, is a time consuming job, as it requires pieces of paper to be individually stuck to the underneath of the backing plate for each printing plate in exactly the right location corresponding to the solid or dark tones of printing. Various other systems have been attempted. One is to make a print of the image on conventional photo paper, and cut out the areas not requiring solid or dark tone printing. Another is by the use of a special light-sensitive plastic sheet. The plastic is exposed to light under a negative and then subjected to heat so that it swells in the areas where solid or dark tone printing is required. With the plastic material, however, the swollen areas tend to compress after a limited printing run, and thus after a few hundred copies have been printed, you no longer have a make-ready sheet. Furthermore, the additional thickness of the plastic sheet, even in the light tone areas, although not swollen, nonetheless increases the overall thickness of the printing plate which is not desirable as it provides a drag on the paper causing extra wear on the press gears during printing.

An object of the present invention is to provide a flexible letter press printing plate which has two levels of printing surface, a high level representing solid or dark tones of printing and a low level representing light tones of printing. Another object is to provide an improved method of making a flexible letter press printing plate which prints evenly and avoids the printing problems herein described.

With these and other objects in view, the present invention provides a letter press printing plate comprising a flexible metal backing plate with a light-sensitive material layer, preferably photo polymer, on at least one side representing the printing surface of the plate, the layer having two levels, the high level representing areas of solid or dark tones of printing and the low level representing areas of light tones of printing. In other embodiments, the difference between the two levels is in the range of 0.005 to 0.008 inch. The areas of high level, representing solid or dark tones, have a second photo polymer layer on the other side of the backing plate. The other side of the backing plate has depressions therein of even depth directly opposite the areas of high level representing solid or dark tones, and these depressions may be filled with a filling material such that the other side of the backing plate is level.

The present invention also provides a method of forming a letter press printing plate from a flexible metal backing plate having an even photo polymer layer on at least one side thereof, comprising the steps of exposing the photo polymer layer on the backing plate to a first negative representing areas of solid or dark tones and light tones of printing, dissolving away the photo polymer layer to the backing plate in areas where no printing occurs to form a printing surface, and forming a two-level printing surface with the areas of solid or dark tones being at a high level and the areas of light tones being at a low level. In other embodiments the forming of the two-level printing surface comprises the steps of applying a second photo polymer layer to the other side of the backing plate, exposing the second photo polymer layer to a second negative aligned with the printing surface and representing areas of solid or dark tones of printing, dissolving away the second photo polymer layer except where areas of solid or dark tones of printing occur. In another embodiment the forming of the two-level printing surface comprises the steps of exposing a second photo polymer layer on a second plate to a second negative representing areas of solid or dark tones of printing, dissolving away the second photo polymer layer except where areas of solid or dark tones of printing occur, positioning and aligning the backing plate with the printing surface upwards on top of the second plate with the second photo polymer layer upwards, pressing the backing plate against the second plate to form depressions in the other side of the backing plate representing areas of solid or dark tones of printing, and forming the high level and low level printing surface.

In drawings which illustrate embodiments of the invention:

FIG. 2 is a cross-sectional elevation of a printing plate of the type known in the prior art.

FIG. 3 is a cross-sectional elevation of a plate with a photo polymer layer having high level areas representing solid or dark tones of printing.

FIG. 4 is a cross-sectional elevation of a printing plate of the present invention showing two levels of printing, a high level representing areas of solid and dark tones and a low level representing areas of light tones. The backing plate has depressions underneath the high level areas.

FIG. 5 is a cross-sectional elevation of another embodiment of a printing plate similar to that shown in FIG. 4 with the depressions in th backing plate filled in.

FIG. 6 is a cross-sectional elevation of another embodiment of a printing plate of the present invention having areas of photo polymer material on the under surface of the backing plate representing solid or dark tones of printing.

Figure 1:
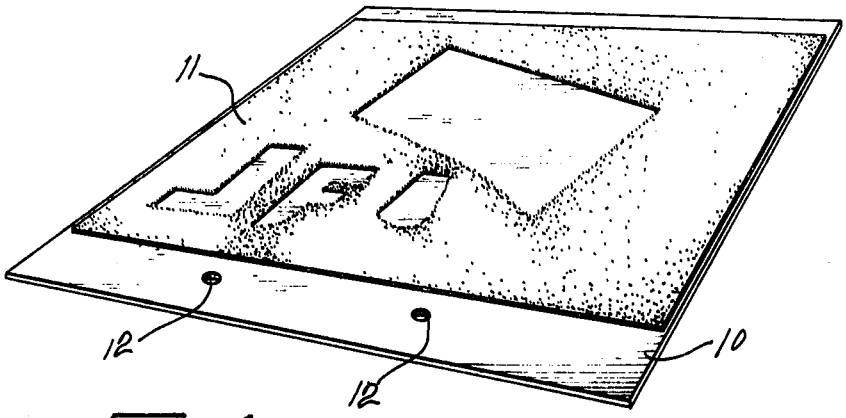
FIG. 1 is an isometric view of a flexible printing plate in the flat position.

Referring now to the drawings, FIG. 1 shows a flexible printing plate with a metal backing plate 10 having a light-sensitive layer 11 such as a photo polymer coated on one side and image on the printing surface. Two positioning holes 12 are located on one edge of the plate 10 to position the plate for the development step. The backing plate may be aluminum or any other suitable flexible sheet metal.

Figures 2, 3, 4, 5, 6:
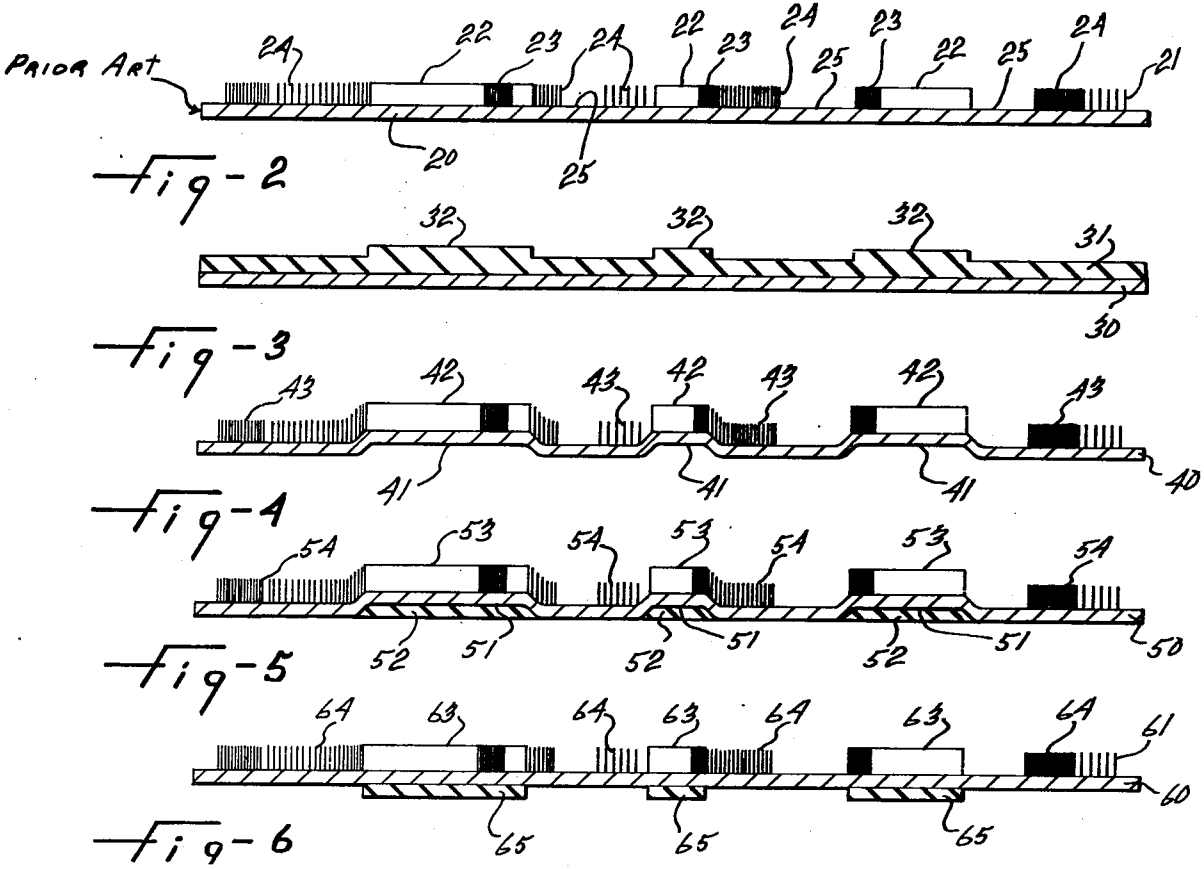
PRIOR ART Fig-2

FIG. 2 shows a letter press printing plate of the type known in the prior art. A flexible metal backing plate 20 has an even thickness photo polymer layer 21 coated on one surface thereof, which after development from exposure to a negative produces solid areas 22, dark tone areas 23, light tone areas 24 and areas of no printing 25. The resultant printing plate has two surfaces, one where printing is desired and one where no printing is desired. There is only one printing surface at one level.

FIGS. 2, 3 and 4 illustrate some of the steps required to produce a printing plate having two printing surfaces at different levels by one embodiment of the present invention. FIG. 2 shows the first stage which requires the production of a standard printing plate with a single printing surface. The second stage is to produce another negative of the image to be printed. In this case the negative is made having transparent areas representing only the areas of solid or dark tones of printing. No dots would occur on the negative representing light tones. Such a negative is then used to print on an untouched photo polymer pre-coated plate such as that used for the printing plate shown in FIG. 2. After being exposed to the negative this pre-coated second plate is passed through a washer to dissolve a portion of the photo polymer layer which has not been hardened by exposure to light. However, unlike the printing plate which is passed through the washer to wash all the photo polymer down to the backing plate, this second plate is only washed for a short time to remove a portion of the thickness of material. Such a plate is shown in FIG. 3. The metal backing plate 30 has a photo polymer layer 31 coated thereon. The thickness of the photo polymer layer 31 is initially the same as the thickness of the photo polymer layer 21 on the printing plate 20. By careful timing in the washer after exposure under the negative to intense light, only an even thickness of the photo polymer material not exposed to light is removed from the layer 31, thus leaving high level areas 32 which represent areas of solid or dark tones of printing. The printing plate as shown in FIG. 2 and the second plate as shown in FIG. 3 are then aligned with the first plate on top of the second plate and passed under a press or pair of rolls to deform the backing plate of the printing plate as shown in FIG. 4. The sheet metal backing plate 40 of the printing plate has depressions 41 in the back surface thereof, which correspond to the high level areas 32 of the second plate 30. Thus the printing surface of the finished printing plate has two separate printing surface levels. The high level 42 represents the areas of solid or dark tones of printing, whereas the low level 43 represents the areas of light tones of printing and has spaced apart dots which may be described as small columns extending up from the upper surface of the backing plate 40.

In one example of this embodiment the thickness of the photo polymer layer on the printing plate is 0.020 inch. The second plate has a photo polymer coating of the same thickness, but after careful control in the development of the plate, a layer of 0.006 inch was removed from the areas of photo polymer which had not solidified on exposure to light.

When the finished printing plate as shown in FIG. 4 is wrapped around a drum, a space is left where the depressions 41 occur between the drum surface and the back of the backing plate 40. Provided the plate is sufficiently rigid such depressions do not affect the printing of the plate. However, in some cases where a large number of prints are to be run off a single printing plate, the depressions 41 in the backing plate 40 may be filled as shown in FIG. 5. In this embodiment a printing plate 50 similar to that shown in FIG. 4 has the depressions 51 filled with a filling material 52. This again gives the two levels of printing surface, the high level 53 for the solid or dark tones and the low level 54 for the light tones. A suitable filling material is a photo polymer filling material. However, any other material, which flexes when the plate is wrapped around the drum but does not compress when printing occurs, is suitable.

A preferred range of differences between the high printing level and the low printing level is between 0.005 to 0.008 inch. By experience this is found to be suitable for newsprint.

Another embodiment of the same invention is shown in FIG. 6 wherein a backing plate 60 is initially made with a first layer of photo polymer material 61 coated on one side of the plate 60 and a second layer 62 on the other side of the plate. The first layer 61 has a thickness of preferably 0.020 inch which is the standard thickness for commercially available prepared printing plates. The first layer 61 is exposed under a negative and developed in the normal manner to produce a printing surface having solid or dark tone areas 63 and light tone areas 64. The second layer 62 on the back of the backing plate 60 has a thickness of at least half that of the first layer 61 and preferably in a range of 0.005 to 0.008 inch. A second negative is used for exposing the second layer 62. This second negative has the light tone areas and areas of no printing opaque so that only the solid or dark tone areas occur. After exposing the second layer 62 under a light, the plate is developed, washing away the photo polymer material, leaving only the solid or dark tone areas 65. The printing surface must be aligned with the negative for producing the under surface such that the solid or dark tone areas 65 in the second layer 62 coincide exactly with the solid or dark tone areas 63 on the printing surface of the plate 60.

Figure 7:
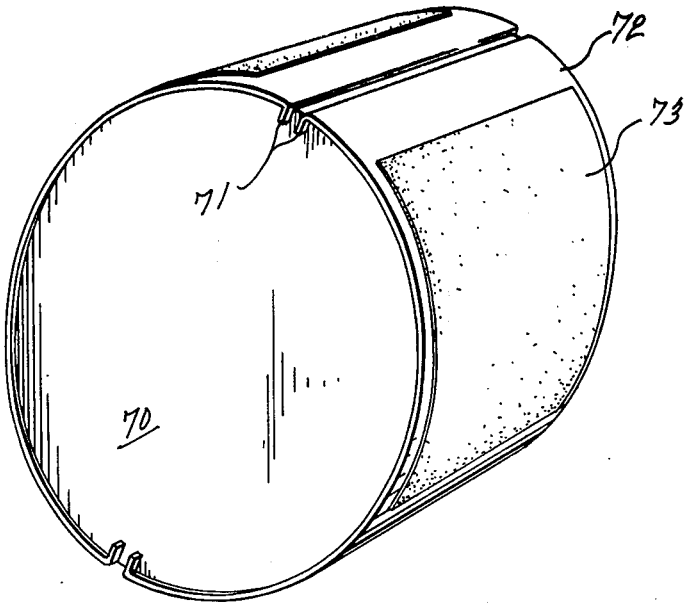
FIG. 7 is an isometric view of a drum having two flexible printing plates mounted thereon (shown with FIG. 1).

The finished printing plate of the type shown in FIGS. 4, 5 or 6 is placed on a drum 70 as shown in FIG. 7 for printing. Crimped edges 71 are formed on the printing plate 72 and fit into slots to position each printing plate 72 on the drum 70. Two printing plates 72 are shown each extending for half the circumference of the drum 70. The printing surface 73 on each plate 72 prints on a paper that moves at the same speed as the printing surface. The pressure between the printing surface of the drum and the paper is controlled to ensure the correct amount of ink is transferred to the paper. The solid or dark tone areas are pressed further into the paper than the light tone areas, and this counters the fact that the dots print better than solid areas. Thus the resulting print has ink evenly distributed over all the areas.

The embodiments of the invention in which an exclusive property or privilege is claimed are defined as follows:

1. A letter press printing plate comprising a flexible metal backing plate with a photopolymerized layer on at least one side representing the printing surface of the plate, the layer having two levels, the high level representing areas of solid or dark tones of printing and the low level representing areas of light tones of printing, and the other side of the backing plate has depressions therein of even depth directly opposite the areas of high level representing solid or dark tones.

2. The printing plate according to claim 1 wherein the difference between the high level and the low level of the layer is in the range of 0.005 to 0.008 inch.

3. The printing plate according to claim 1 wherein the depressions in the backing plate are filled with a filling material such that the other side of the backing plate is level, and wherein the photopolymerized layer has a constant thickness.

4. The printing plate according to claim 3 wherein the difference between the high level and the low level is in the range of 0.005 to 0.008 inch, and the depth of the depressions in the other side of the backing plate is the same difference.

* * * * *